United States Patent [19]

Hanser

[11] Patent Number: 4,732,534

[45] Date of Patent: Mar. 22, 1988

[54] ROTOR BLADE JACKET FOR AXIAL GAS TURBINES

[75] Inventor: Hagen Hanser, Munich, Fed. Rep. of Germany

[73] Assignee: MTU Motoren-und Turbinen-Union Muenchen GmbH, Munich, Fed. Rep. of Germany

[21] Appl. No.: 911,295

[22] Filed: Sep. 24, 1986

[30] Foreign Application Priority Data

Oct. 2, 1985 [DE] Fed. Rep. of Germany ..... 3535106

[51] Int. Cl.[4] ..... F01D 11/08

[52] U.S. Cl. ..... 415/136; 415/174

[58] Field of Search ..... 415/127, 128, 134–136, 415/138, 170 R, 172 A, 174, 197

[56] References Cited

U.S. PATENT DOCUMENTS 3,607,600 9/1971 Schreter et al. ..... 415/197 X
4,087,199 5/1978 Hemsworth et al. ..... 415/197 X
4,411,594 10/1983 Pellow et al. ..... 415/174
4,422,648 12/1983 Eaton et al. ..... 415/174 X

FOREIGN PATENT DOCUMENTS 28554 5/1981 European Pat. Off. ..... 415/174
1020900 2/1966 United Kingdom ..... 415/174
1484288 9/1977 United Kingdom ..... 415/174

*Primary Examiner*—Robert E. Garrett
*Assistant Examiner*—Joseph M. Pitko
*Attorney, Agent, or Firm*—W. G. Fasse; D. H. Kane, Jr.

[57] ABSTRACT

A rotor blade jacket for an axial gas turbine has a closed ceramic ring surrounding the blade tips of the turbine rotor and surrounded by a protective metal ring holding heat expansion compensating bristles which are secured at their radially outer ends to the protective metal ring and at their radially inner ends to the ceramic ring, whereby the ceramic ring is supported and centered in the turbine housing.

5 Claims, 2 Drawing Figures

ROTOR BLADE JACKET FOR AXIAL GAS TURBINES

FIELD OF THE INVENTION

The invention relates to a rotor blade jacket for axial gas turbines, wherein the jacket protects the rotor blades by allowing a heat expansion compensation.

DESCRIPTION OF THE PRIOR ART

British Patent Publication No. 2,051,962, corresponding to U.S. Pat. No. 4,411,594, (Pellow, et al.), discloses such a rotor blade jacket, wherein brush bristles in a circumferential jacket ring forming part of the turbine housing, are connected only at their radially outer ends to the jacket ring. The radially inner ends of the brush bristles are free and are therefore not well suited for the purpose of simultaneously centering a ceramic ring which surrounds the rotor blade tips and for properly mounting the ceramic ring in the turbine housing. Thus, the ceramic ring, or rather its position, is not exactly defined. In spite of this deficiency, rotor blade jackets of this type, including the ceramic ring, have the advantage, compared to conventional turbine jacket rings of metal, that the ceramic ring is resistant to high temperatures, thereby avoiding expensive and structurally involved cooling devices.

German Patent Publication (DE-OS) No. 2,737,622 discloses an apparatus which attempts to solve the problem of different heat expansions between the ceramic wall components and the outer metal housing by dividing the ceramic wall components into individual segmented blocks inserted into dovetailed sockets. These sockets are mounted to expand freely in response to temperature increases in respective chambers of the metal housing. This type of structure provides a reasonably good centering of the ceramic ring members, however the construction is complicated and hence expensive.

OBJECTS OF THE INVENTION

In view of the foregoing it is the aim of the invention to achieve the following objects singly or in combination:

to provide a rotor blade jacket for an axial gas turbine which combines the advantages of the prior art without entailing the stated disadvantages;

to employ a ceramic ring with its advantageous characteristics relative to heat resistance, corrosion, and erosion resistance while simultaneously assuring its proper centering and mounting without the use of dovetail mounting components; and to construct such a protective jacket so that it is easily cooled, simple in its structure, and facilitates any maintenance work compared to prior art structures.

SUMMARY OF THE INVENTION

According to the invention the jacket comprises an outer metal ring and an inner ceramic ring interconnected by brush bristles which are secured at their radially outer ends to the outer metal ring of the jacket, and which are secured at their radially inner ends to the outer circumferential surface of the ceramic ring, thereby properly mounting the ceramic ring while simultaneously centering the ceramic ring.

The most important advantage of the invention is seen in that the brush bristles, due to their positive connection at both ends, hold the ceramic ring in a defined position, while simultaneously centering the ceramic ring, wherein the entire jacket construction is simple. The cross-sectional configuration of the ceramic ring may also be simple, for example, a rectangular cross-section has been found to be satisfactory. The different heat expansions between the ceramic ring on the one hand and the metal housing of the axial turbine on the other hand, are compensated by the bristles which form a brush extending circumferentially all around the ceramic ring. It has been found, surprisingly, that in spite of the connection of the brush bristles at both ends, the bristles are not subject to any uncontrollable bending as a result of different temperature expansions, even substantial different temperature expansions between the ceramic ring and the metal housing. Rather, these bristles permit a small relative rotation of the ceramic ring relative to the metal housing, whereby the bristles are subjected only to a very insignificant bending.

In a preferred embodiment of the invention, the bristle of the circumferential brush are made of metal, for example, ductile metal. These metal bristles become ductile at high temperature, which is advantageous because it facilitates the heat expansion compensation. Yet another advantage of using metal bristles is seen in that the connection of the bristle ends to the metal housing and to the ceramic ring can be accomplished by simple means, for example, soldering or brazing.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
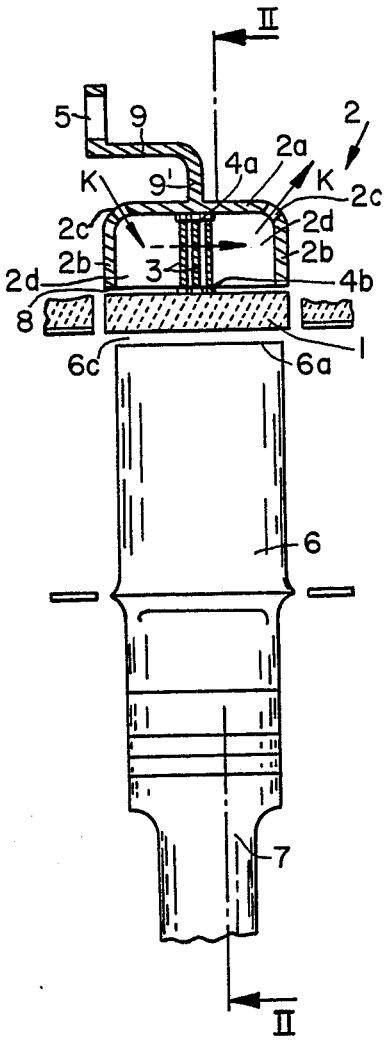
FIG. 1 is an axial longitudinal section through the protective jacket of a rotor disk.
Figure 2:
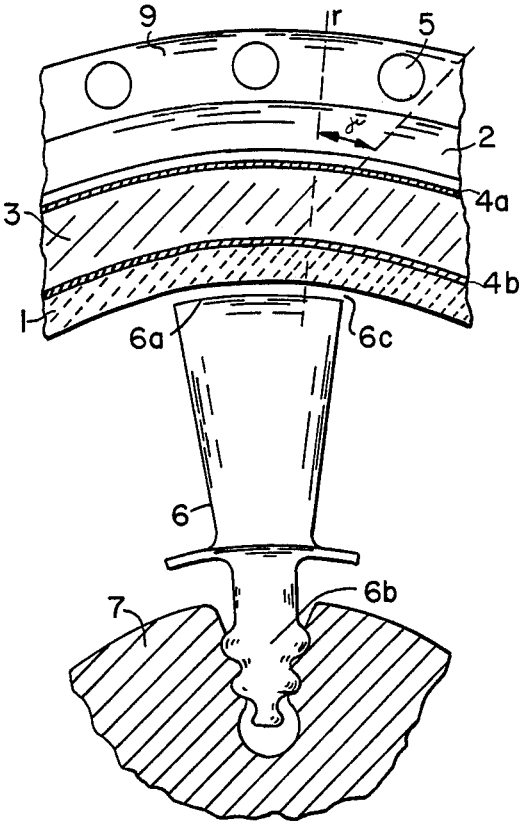
FIG. 2 is a sectional view along section line II—II in FIG. 1.

FIG. 1 only shows one rotor blade 6 of the rotor disk 7 of an axial flow rotor of a gas turbine. The root **6*b* of each rotor blade 6 is conventionally anchored in the rotor disk 7 as shown in FIG. 2. The radially outer tips 6*a* of the rotor blades 6 are surrounded, across the air gap 6*c* by a ceramic ring 1 which, according to the invention, is mounted by brush bristles 3 to be described in more detail below. The gap 6*c* is held to a minimum. The ceramic ring 1** is preferably made of silicon nitride or silicon carbide.

The ceramic ring 1 is mounted and centered in a metal housing 9 by the above mentioned metal bristles 3. The metal housing 9 comprises a protective ring 2 having an axial wall portion **2*a* and two radial wall portions 2*b* to form a chamber in which the bristles 3 are housed. The upper ends of the bristles are secured by securing means such as soldering connections or joints 4*a*, to the radially inwardly facing surface of the axial wall portion 2*a* of the ring 2. The side walls 2*b* form with the axial wall portion 2*a* a bristle protecting channel, whereby the side walls extend radially inwardly to form a small gap 8 between the radially inwardly facing edges of the side walls 2*b* and the radially outer surface of the ceramic ring 1. A cooling chamber 2*d* is formed between the bristles 3 and each side wall 2*b*. Cooling medium flow openings 2*c*** are provided in the bristle protecting channel or ring 2. The arrows K indicate the flow of a cooling medium such as cooling air.

According to the invention the radially inner ends of the bristles 3 are connected to the ceramic ring 1, for example, by a brazed connection or soldered connection 4*b*.

The downwardly facing open side of the cooling chambers 2*d* faces the circumferentially outer surface of the ceramic ring 1.

The protective ring or channel 2 does not need to be made as an integral single piece component. Rather, the channel could, for instance, be formed by two mirror-symmetrical sections connected to each other by two flange portions 9'. The flange 9' or rather two such flange portions would be connected to other turbine components in the same way as shown in FIG. 1, whereby the holes 5 are used for such connection.

FIG. 2 shows the slanted position of the bristles 3 relative to the radial direction r as indicated by the angle $\gamma$.

The just described construction of the protecting ring or channel 2 with two cooling chambers 2*d* has the advantage that a very effective cooling airstream K can be guided between the metallic bristles 3 which are thus effectively protected against excessive temperatures without requiring a large quantity of cooling air. Due to the fact that the bristles 3 are enclosed or flanked by two cooling ring chambers 2*d*, the throughput of cooling air can be very low due to its efficient use. For example, the quantity of cooling air K may amount only to about 0.1% of the entire cooling air needed for the axial gas turbine, or for the gas turbine power plant.

Although the invention has been described with reference to specific example embodiments, it will be appreciated, that it is intended to cover all modifications and equivalents within the scope of the appended claims.

What I claim is:

1. A rotor blade jacket for an axial gas turbine having a rotor with rotor blades exending in a radial direction, comprising a closed ceramic ring surrounding said rotor blades, metal housing ring means surrounding said closed ceramic ring, brush ring means comprising bristles all of said bristles extending at the same slant relative to said radial direction between said housing metal ring means and said closed ceramic ring for centering said closed ceramic ring in a heat expansion compensating manner, first means for operatively securing radially outer ends of said bristles to said metal housing ring means, and second means for operatively securing radially inner ends of said bristles to an outer circumference of said closed ceramic ring, whereby said closed ceramic ring is positively positioned, held, and centered around said rotor blades by said brush ring means.

2. The rotor blade jacket of claim 1, wherein said brush bristles comprise metal bristles.

3. The rotor blade jacket of claim 1, wherein said first and second means for securing said bristles comprise solder or brazing connections.

4. The rotor blade jacket of claim 1, wherein said housing metal ring means comprise a ring member having an axial wall portion and two radially inwardly extending wall portions forming a radially inwardly open bristle protecting channel, said bristles being located in said bristle protecting channel, said radially inwardly extending wall portions enclosing ring venting chambers between said bristle brush means and said radially inwardly extending wall portions, and venting passages into and out of said venting chambers for passing cooling air through said bristle protecting channel.

5. The rotor blade jacket of claim 4, wherein said radially extending wall portions of said bristle protecting channel have radially inwardly facing edges forming a narrow gap between said closed ceramic ring.

* * * * *